US008939436B2

(12) United States Patent
Takase et al.

(10) Patent No.: US 8,939,436 B2
(45) Date of Patent: Jan. 27, 2015

(54) MICROBUBBLE-GENERATING APPARATUS

(75) Inventors: Ichiro Takase, Kumamoto (JP); Hiroaki Tsutsumi, Kumamoto (JP)

(73) Assignee: Taikohgiken Yuugen Kaisha, Kumamoto (JP)

( * ) Notice: Subject to any disclaimer, the term of this patent is extended or adjusted under 35 U.S.C. 154(b) by 209 days.

(21) Appl. No.: 13/806,910

(22) PCT Filed: Feb. 21, 2011

(86) PCT No.: PCT/JP2011/053658
§ 371 (c)(1),
(2), (4) Date: Dec. 26, 2012

(87) PCT Pub. No.: WO2012/005018
PCT Pub. Date: Jan. 12, 2012

(65) Prior Publication Data

US 2013/0099398 A1 Apr. 25, 2013

(30) Foreign Application Priority Data

Jul. 7, 2010 (JP) ..... 2010-154631

(51) Int. Cl.
*B01F 3/04* (2006.01)
*B01F 5/00* (2006.01)

(52) U.S. Cl.
CPC ..... *B01F 3/04106* (2013.01); *B01F 3/04503* (2013.01); *B01F 5/0062* (2013.01); *B01F 5/0071* (2013.01); *B01F 2003/04858* (2013.01)
USPC ..... 261/76; 261/78.2; 261/118

(58) Field of Classification Search
USPC ..... 261/76, 78.2, 79.2, 115, 118
See application file for complete search history.

(56) References Cited

U.S. PATENT DOCUMENTS

| | | | | |
|---|---|---|---|---|
| 5,004,484 | A * | 4/1991 | Stirling et al. | 95/263 |
| 6,382,601 | B1 | 5/2002 | Ohnari | |
| 7,832,028 | B2 * | 11/2010 | Yayama et al. | 4/541.4 |
| 2009/0201761 | A1 | 8/2009 | Matsuno et al. | |
| 2009/0294996 | A1 | 12/2009 | Matsumato | |

FOREIGN PATENT DOCUMENTS

| | | |
|---|---|---|
| JP | 2003-205228 | 7/2003 |
| JP | 2008-237995 | 10/2008 |
| JP | 2008-246268 | 10/2008 |
| JP | 2009-101329 | 5/2009 |
| JP | 2009-195882 | 9/2009 |
| WO | WO-2008/038763 | 4/2008 |

* cited by examiner

*Primary Examiner* — Robert A Hopkins
(74) *Attorney, Agent, or Firm* — Jordan and Hamburg LLP

(57) ABSTRACT

The micro bubble generator comprises a gas-liquid generating tank and an outer shell tank and the space there between is configured as a channel for the liquid. A plurality of liquid supply ports are provided in the channel and supply liquid through the channel into the gas-liquid generating tank from the liquid supply ports. Inside the gas-liquid generating tank, a swirling flow is generated by the supplied liquid and a negative pressure cavity is thereby generated near the axis of the cylinder axis. From the gas supply portion, gas is supplied from the outside by the action of the negative pressure cavity or by additionally forcing the gas supply. The supplied gas is formed into micro hubbies by the swirling liquid flow and is discharged from the gas-liquid outlet discharging port as a gas-liquid.

6 Claims, 6 Drawing Sheets

(A)

(B)

MICROBUBBLE-GENERATING APPARATUS

TECHNICAL FIELD

The present invention relates to a microbubble generating apparatus generating microbubbles in liquid.

BACKGROUND OF THE INVENTION

A utilization technique of fine bubbles called microbubbles having a diameter of several tens of μm to several μm is attracting attention, in industrial fields. A system including a multiplicity of fine bubbles in liquid has a much greater bubble surface area as compared to a system including a single bubble having the same volume and a residence time of fine bubbles in water etc., is also longer. This enables improvements in the dissolution characteristics of gas into fine bubbles, the characteristics of adsorption of impurities in liquid by fine bubbles, etc., thereby increasing the substance transport effect. A technique of microbubbles is applied in various industrial fields such as fish and shellfish culture, wasterwater treatment, chemical reactors, medical care, and plant cultivation, for example.

An apparatus using a swirling flow of liquid is known as a generating apparatus generating microbubbles. This apparatus generates a swirling flow of liquid inside a tank while introducing liquid into the tank of the microbubble generating apparatus. A negative-pressure cavity portion is generated by the swirling flow in the center of the swirl. Gas is introduced into the tank by a pressure difference due to the negative-pressure cavity portion and the gas is divided by a shearing force of the swirling flow into fine bubbles to generate miorobubbles.

FIG. 6 is a schematic for explaining an example of a microbubble generating apparatus utilizing a swirling flow as described above. The microbubble generating apparatus depicted in FIG. 6 has a cylindrical gas-liquid generating tank 101 and supplies liquid from a liquid supplying portion 102. The liquid is supplied by using a pump etc. A swirling flow C is generated by the liquid supplied into the gas-liquid generating tank 101 and a negative-pressure cavity portion V is generated in the center of the swirl.

A gas supplying portion 103 connected to the gas-liquid generating tank 101 supplies gas. The gas is naturally supplied from the outside due to a negative pressure generated by the negative-pressure cavity portion V. The gas is finely divided by the swirling flow C into microbubbles and discharged along with liquid from a gas-liquid discharging port 104.

FIG. 7 is a schematic for explaining another example of a microbubble generating apparatus utilizing a swirling flow. The microbubble generating apparatus depicted in FIG. 7 supplies liquid from the liquid supplying portion 102 into the gas-liquid generating tank 101 and squirts the liquid from a plurality of nozzles 102*a* disposed inside the gas-liquid generating tank 101. The liquid is supplied by using a pump etc. The swirling flow C is generated by the liquid supplied into the gas-liquid generating tank 11 and the negative-pressure cavity portion V is generated in the center of the swirl.

The gas supplying portion 103 connected to the gas-liquid generating tank 101 supplies gas. The gas is naturally supplied from the outside due to a negative pressure generated, by the negative-pressure cavity portion V. The gas is finely divided by the swirling flow C into microbubbles and discharged along with liquid from the gas-liquid discharging port 104.

For example, Patent Document 1 discloses a configuration of a microbubble (fine bubble) generating apparatus similar to the type of FIG. 6. This apparatus includes a vessel main body having a conical-shaped, bottle-shaped, or wine-bottle-shaped space, a pressurized liquid introducing port opened in a tangential direction at a portion of an inner wall circumferential surface of the space, a gas introducing hole opened in the bottom of the space, and a swirling gas-liquid delivering port opened at the top of the space.

When an apparatus main body having the configuration as described above is submerged in liquid and pressurized liquid is pressurized and sent from the pressurized liquid introducing port into the space, a swirling flow is generated inside the space and a negative pressure portion is formed on a conical tube axis. When gas is sucked from the gas introducing hole due to this negative pressure and the gas passes through the tube axis with the lowest pressure, a thin swirling gas cavity portion is formed. The swirling flow is formed in the space from an inlet to an outlet, and the gas moves toward the outlet while forming a thread-like shape and is squirted along with liquid. The thread-like gas cavity portion is continuously steadily cut and, as a result, fine bubbles, for example, fine bubbles having a diameter of 10 to 20 μm are generated near the outlet and discharged outside the equipment.

PRIOR ART DOCUMENT

Patent Document

Patent Document 1: Japanese Laid-Open Patent Publication No. 2003-205223

SUMMARY OF THE INVENTION

Application of the microbubble generating apparatus is considered in various industrial fields as described above. For example, in the field of fish culture and wasterwater treatment, an apparatus steadily and efficiently generating a large amount of microbubbles is desired. For example, a fish preserve etc., must be supplied with oxygen so as to suppress reduction in amount of dissolved oxygen. In this case, a technique of generating air bubbles in water with a common aeration system is conventionally used; however, a large-scale high-cost system is required for maintaining an amount of dissolved oxygen in an object water area at a necessary level. As a system becomes larger in scale, it is not easy to move the system to a desired location and the system lacks mobility and operability.

Although an attempt is made to meet such requests for downsizing and cost reduction with a system using an apparatus generating microbubbles to raise oxygen concentration in water, an apparatus is desired that can improve the generation efficiency of microbubbles relative to the scale of the apparatus so as to steadily generate a large amount of microbubbles with a simple apparatus.

The present invention was conceived in view of the situations and it is therefore an object of the present invention to provide a microbubble generating apparatus having a simple configuration and portability and capable of generating microbubbles in liquid with high efficiency relative to the scale of the apparatus.

To solve the above problem, a micro bubble generating apparatus of the present invention having a cylindrical gas-liquid generating tank, a liquid supplying portion for supplying liquid to the gas-liquid generating tank, and a gas supplying portion for supplying gas to the gas-liquid generating tank, generates a swirling flow of the liquid supplied by the liquid supplying portion along an inner surface of a cylinder in the gas-liquid generating tank, produces gas-liquid which is a mixture of the supplied liquid and a gas that is generated by micro bubbling the gas supplied from the gas supplying portion by a shearing force of the swirling flow, and discharges the produced gas-liquid, wherein a gas supplying port for supplying the gas to the gas-liquid generating tank by the gas supplying portion is disposed on one of circular wall surfaces sealing both end portions of the cylinder of the gas-liquid generating tank, an outer shell tank at least partially covering the gas-liquid generating tank is included, the outer shell tank forms a gap between a side wall forming a circumferentially curved surface of the cylinder of the gas-liquid generating tank and the outer shell tank as well as a gap between the circular wall surface of the gas-liquid generating tank disposed with the gas supplying port and the outer shell tank to define a space made up of the gaps as a flow passage of the liquid, the liquid is supplied to the flow passage on the outside of the circular wall surface, the supplied liquid flows into the flow passage on the outside of the side wall, the gas-liquid generating tank has liquid supplying ports in communication with the flow passage outside the side wall and the inside of the gas-liquid generating tank to supply the liquid supplied to the flow passage into the inside of the gas-liquid generating tank, a plurality of the liquid supplying ports are disposed at least in a radial direction of the side wall, a liquid supply direction is set such that the liquid swirls in a constant direction around an axis of the gas-liquid generating tank, and the liquid supplying portion supplies the liquid through the flow passage from the liquid supplying ports into the inside of the gas-liquid generating tank to generate the swirl flow.

Also, the micro bubble generating apparatus of the present invention is characterized in that the gas supplying port for supplying the gas into the gas-liquid generating tank by the gas supplying portion and a gas-liquid discharging port for discharging the produced gas-liquid from the gas-liquid generating tank are disposed on a cylinder axis of the gas-liquid generating tank, out of the circular wall surfaces sealing the both end portions of the cylinder of the gas-liquid generating tank, the circular wall surface on the side including the gas supplying port forms a concave curved shape in a radial direction on a wall surface between the center and the outer circumference of the circular wall surface, and the concave shape is a shape having a concave bottom portion on the outer side of the gas-liquid generating tank.

Further, the microbubble generating apparatus of the present invention is characterized in that the liquid supply ports are disposed in a plurality of locations for each of a plurality of different positions in the cylinder axis direction of the gas-liquid generating tank.

Further, the micro bubble generating apparatus of the present invention is characterized in that a pump making up the liquid supplying portion and an electric motor for driving the pump are integrally configured with the gas-liquid generating tank covered by the outer shell tank.

Further, the micro bubble generating apparatus of the present invention is characterized in that a gas supply pipe allowing communication between the inside of the gas-liquid generating tank of the micro bubble generating apparatus and outside air is included as the gas supplying portion.

Further, the microbubble generating apparatus of the present invention comprises a compressor connected to an end portion of the gas supply pipe, wherein a gas is delivered into the gas-liquid generating tank by operation of the compressor.

The present invention can provide a microbubble generating apparatus having a simple configuration and portability and capable of generating microbubbles in liquid with high efficiency relative to the scale of the apparatus.

DESCRIPTION OF THE PREFERRED EMBODIMENTS

Figure 1:
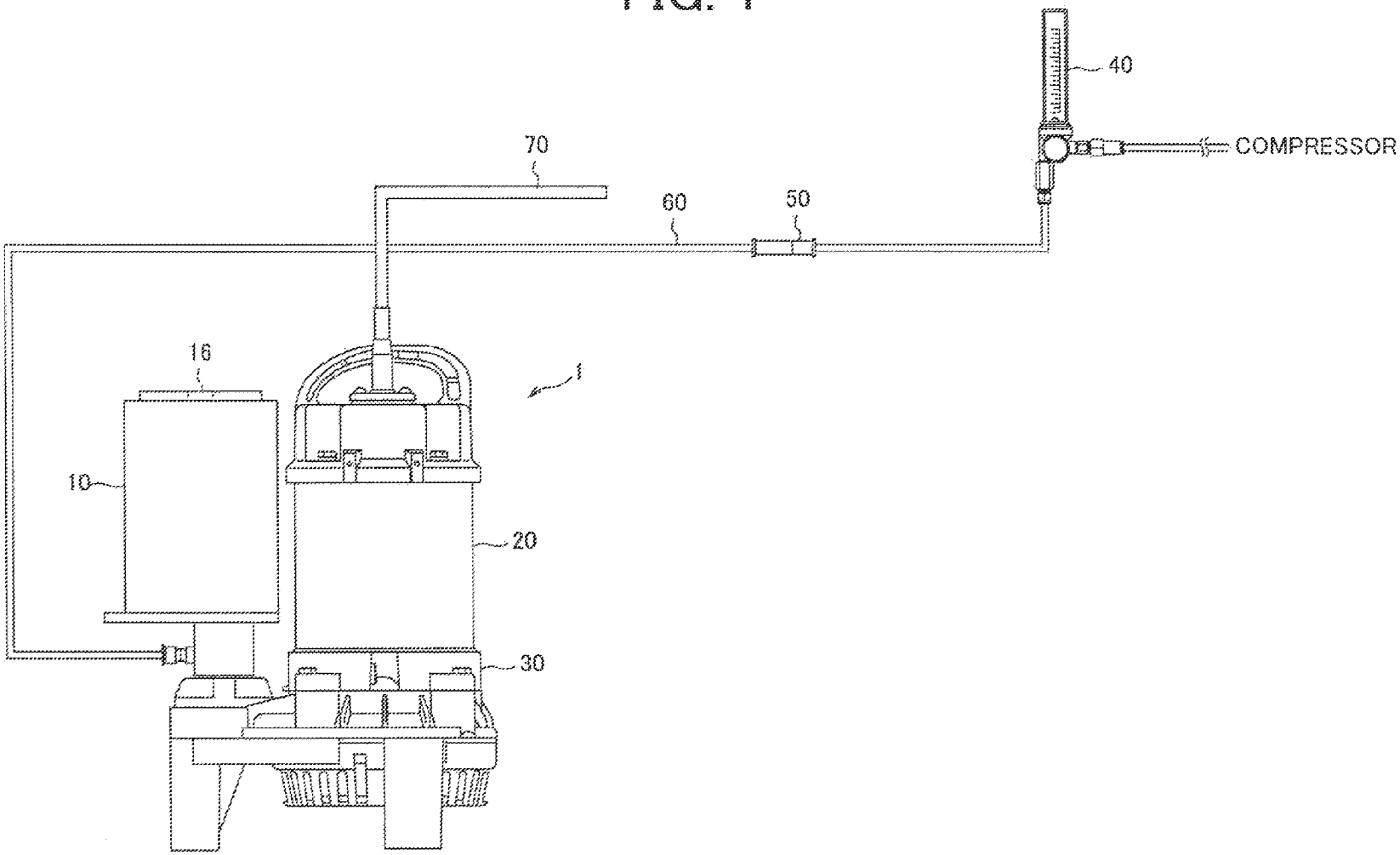
FIG. 1 is a diagram for explaining an exemplary system configuration to which a microbubble generating apparatus according to the present invention is applied.
Figure 2:
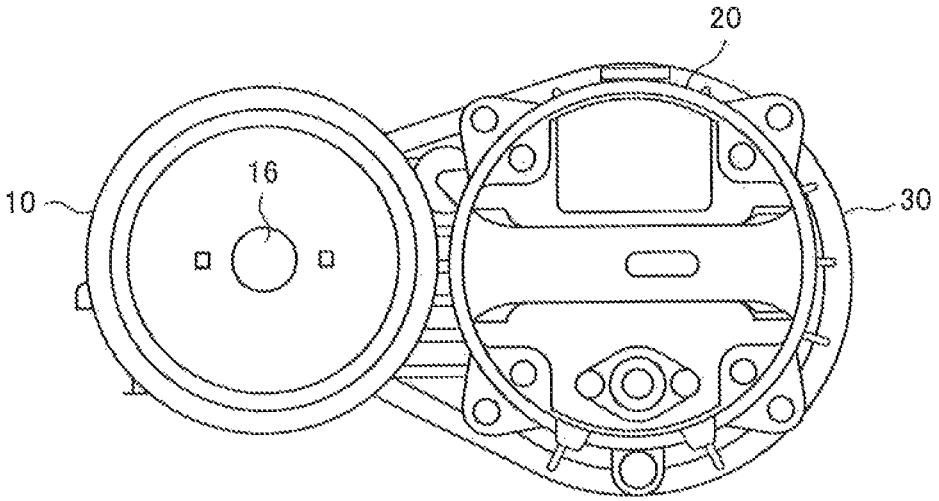
FIG. 2 is a schematic of a top surface of the microbubble generating apparatus depicted in FIG. 1.

FIGS. 1 and 2 are diagrams for explaining an exemplary system configuration to which a microbubble generating apparatus according to the present invention is applied. A system of FIG. 1 represents an exemplary configuration of a system utilized in a location with a relatively deep water depth (e.g., water depth on the order of 5 to 12 m) such as a fish farm on the sea, for example. FIG. 2 is a schematic of a top surface of a microbubble generating apparatus 1 depicted in FIG. 1.

The microbubble generating apparatus 1 includes a microbubble generator 10 generating microbubbles in liquid and discharging the microbubbles to the outside of the generator, a waterproof pump 20 for sucking and pumping surrounding liquid (seawater in the case of a marine fish farm) into the microbubble generator 10, and an electric motor 30 for driving the pump 20 and is formed by integrally configuring the microbubble generator 10, the pump 20, and the electric motor 30.

The microbubble generating apparatus 1 according to the present invention is operated while being placed in liquid such as seawater and the surrounding liquid is taken and pumped by the pump 20 into the microbubble generator 10. The microbubble generator 10 takes in gas at the same time from the outside, produces gas-liquid while generating microbubbles in the liquid, and discharge the produced gas-liquid from a gas-liquid discharging port 16 into the surrounding liquid. The gas-liquid discharged from the microbubble generator 10 is discharged from the gas-liquid discharging port 16 disposed on the upper portion of the microbubble generator 10.

The microbubble generating apparatus 1 is connected to a power code 70 and is also connected to a gas supply pipe 60 for supplying gas into the microbubble generator 10. The power code 70 is connected to a power source not depicted and supplies electric power for driving the pump 20.

The gas supply pipe 60 is connected to a compressor not depicted and compressed gas (e.g., air) is supplied from the compressor to the microbubble generator 10. A flowmeter 40 for checking a gas flow rate from the compressor and a check valve 50 for preventing a back-flow of liquid from the microbubble generator 10 are disposed in the middle of the gas supply pipe 60.

Although the microbubble generator 10 of the embodiment according to the present invention has an effect of supplying gas from the outside due to a negative-pressure cavity portion generated by a swirling flow, when the microbubble generator 10 is used in a location with a relatively deep water depth as in this example, microbubbles can more efficiently be generated by using the compressor to forcibly supply gas.

Figure 3:
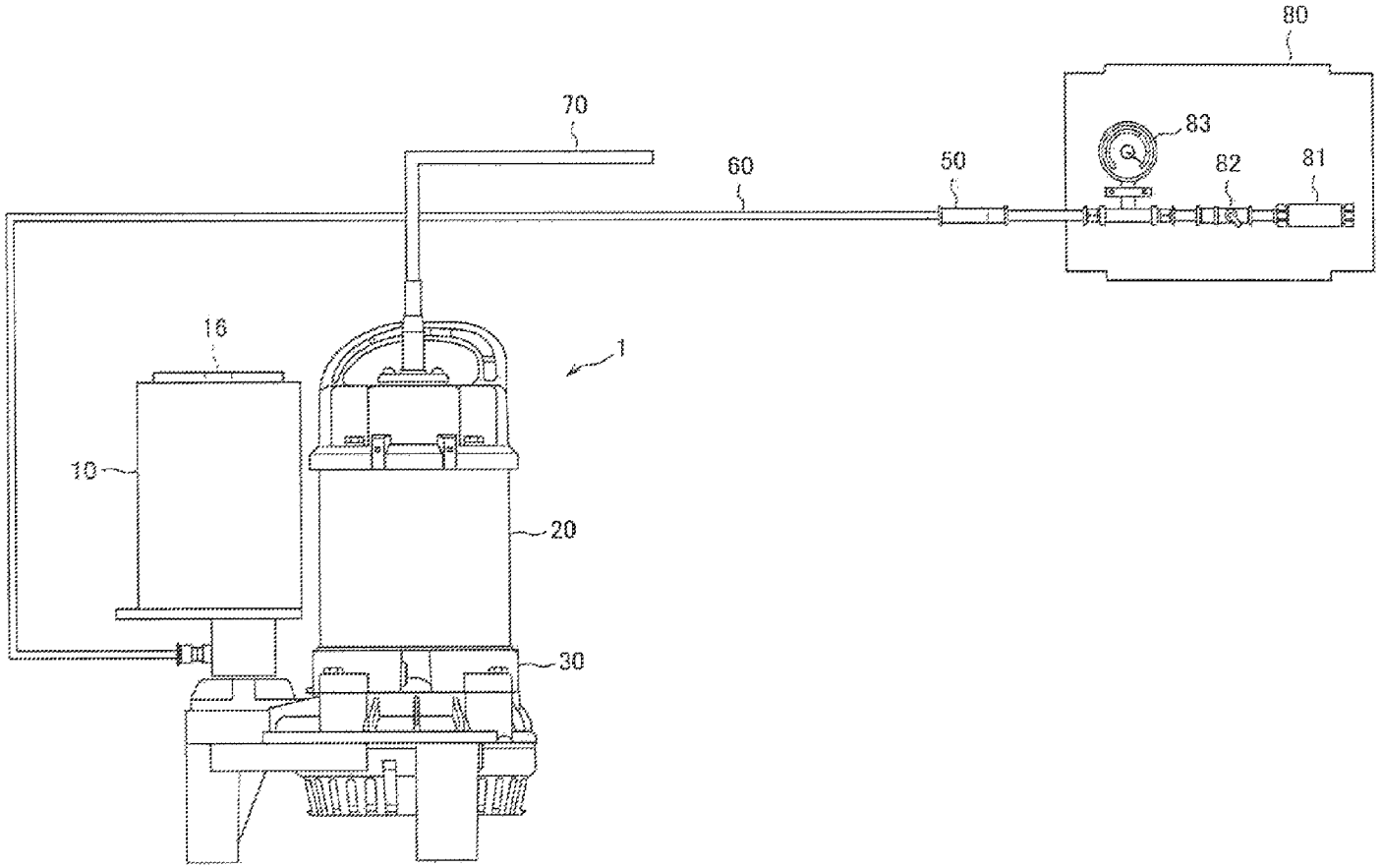
FIG. 3 is a diagram for explaining another exemplary configuration of a system to which the microbubble generating apparatus according to the present invention is applied.

FIG. 3 is a diagram for explaining another exemplary configuration of a system to which the microbubble generating apparatus according to the present invention is applied and the portions having the same functions as FIG. 1 are denoted by the same reference numerals.

The system of FIG. 3 represents an exemplary configuration of a system utilized in a location with a relatively shallow water depth in the case of a smaller scale such as for growing seed and seedling, for example.

Unlike the system of FIG. 1, the system of FIG. 3 is applied to a location with a relatively shallow water depth and, therefore, outside air is naturally supplied by the effect of a negative-pressure cavity portion generated by a swirling flow in the microbubble generator 10 without using a compressor to forcible supply gas into the microbubble generator 10.

Therefore, an end portion of the gas supply pipe 60 connected to the microbubble generator 10 is disposed with an operating panel 80 including an air filter 81, an air control cock 82 for adjusting an intake amount of outside air, and a negative-pressure meter 83.

Since the system of this example is used at a relatively shallow water depth, a flow passage may be configured to change the discharge direction of the gas-liquid discharged from the gas-liquid discharging port 16 to a downward direction or a lateral direction from the apparatus rather than discharging the gas-liquid discharged from the gas-liquid discharging port 16 directly in an upward direction from the apparatus such that microbubbles can be released into liquid even when the microbubble generating apparatus 1 is not entirely submerged under the liquid surface.

The other constituent elements are the same as the system of FIG. 1 and will not repeatedly be described.

Figure 4:
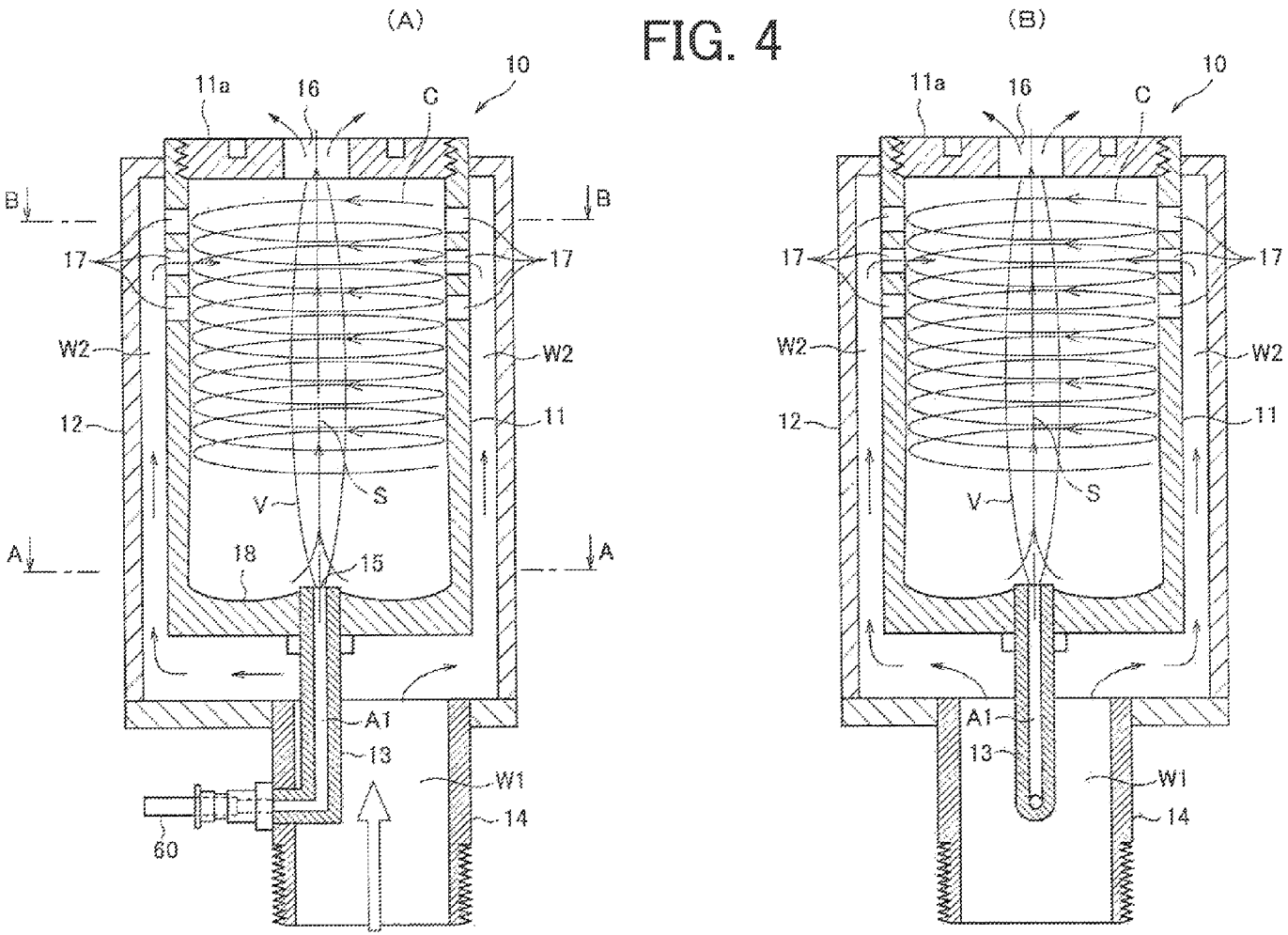
FIG. 4 is a diagram for explaining a configuration of a micro bubble generator included in the microbubble generating apparatus according to the present invention.
Figure 5:
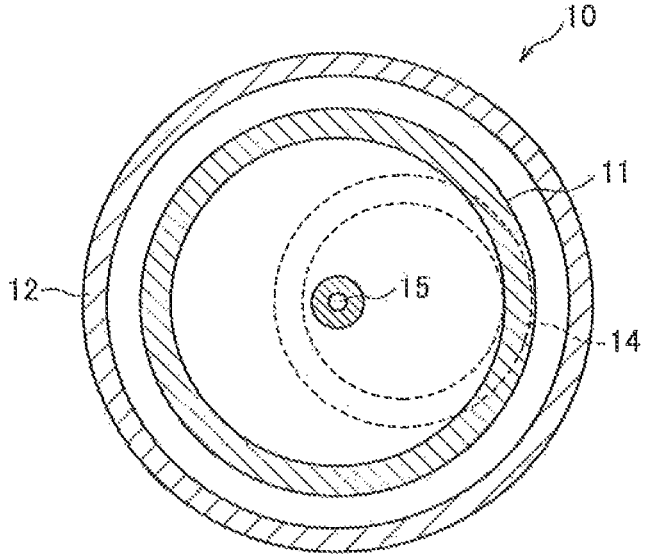
FIG. 5 is another diagram for explaining a configuration of the micro bubble generator included in the micro bubble generating apparatus according to the present invention.
Figure 5:
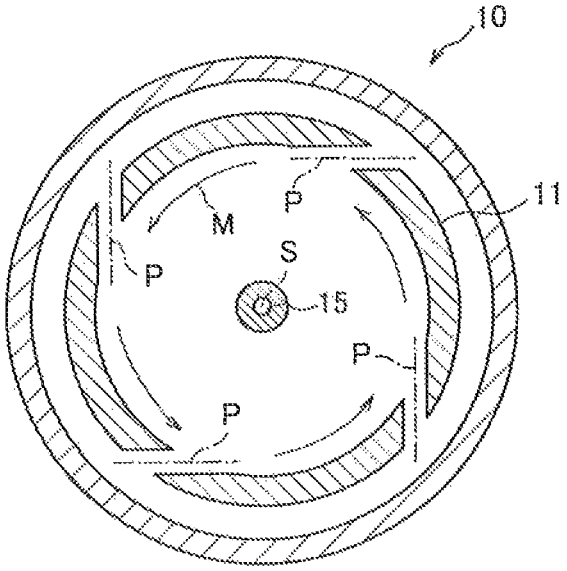
Figure 6:
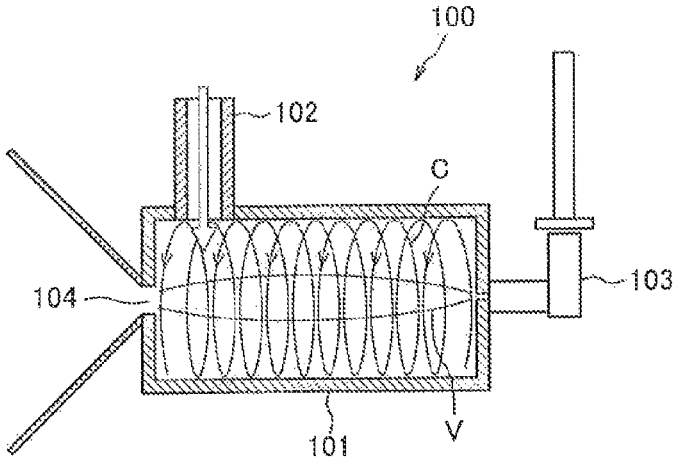
FIG. 6 is a schematic for explaining an example of a conventional microbubble generating apparatus utilizing a swirling flow.

FIGS. 4 and 5 are diagrams for explaining a configuration of the microbubble generator included in the microbubble generating apparatus according to the present invention; FIG. 4(A) is a general configuration diagram of a cross section of the microbubble generator viewed from the front side; and FIG. 4(B) is a general configuration diagram of a cross section of the microbubble generator viewed from a lateral side. FIG. 5(A) is a diagram of a general configuration of a cross section taken along A-A of FIG. 4 and FIG. 5(B) is a diagram of a general configuration of a cross section taken along B-B of FIG. 4.

The microbubble generator 10 has a gas-liquid generating tank 11 for generating microbubbles in liquid to produce gas-liquid and an outer shell tank 12 at least partially covering the outside thereof. A liquid supplying portion 14 is disposed on the lower portion of the outer shell tank 12. A flow passage W1 of liquid is formed inside the liquid supplying portion 14 and the flow passage W1 is connected to the pump 20 described above. The liquid (e.g., seawater) surrounding the apparatus is sucked by the operation of the pump 20 and is supplied from the pump 20.

A predetermined space is formed between the gas-liquid generating tank 11 and the outer shell tank 12 and this space is configured as a flow passage W2 of the liquid. The flow passage W1 and the flow passage W2 are in communication with each other and, therefore, the liquid pumped from the pump 20 flows from the flow passage W1 into the flow passage W2.

The upper portion of the flow passage W2 is disposed with a plurality of liquid supply ports 17 in communication with the inside of the gas-liquid generating tank 11. The liquid supplied from the flow passage W1 to W2 is supplied from the plurality of the liquid supply ports 17 to the inside of the gas-liquid generating tank 11.

As depicted in FIG. 5(B), the liquid supply ports 17 has a liquid supply direction set such that the liquid swirls in a constant direction (direction of an arrow M in this case) around a cylinder axis S of the gas-liquid generating tank 11. Therefore, the liquid supply ports 17 are formed to squirt the liquid in the direction toward twisted positions relative to the cylinder axis S of the cylindrical gas-liquid generating tank 11.

The liquid supply ports 17 are disposed at a plurality of different positions in the direction of the cylinder axis S of the gas-liquid generating tank 11 and in a plurality of locations for each of the positions. In the case of this example, the liquid supply ports 17 are disposed on three rows in the height direction of the gas-liquid generating tank 11 and are disposed in four locations at regular intervals in the circumferential direction of the gas-liquid generating tank 11 for each row. Therefore, the gas-liquid generating tank 11 is disposed with a total of the 12 liquid supply ports 17. The number of the liquid supply ports 17 and the number of arranged rows are not limited to the example described above and can be set as needed.

The gas supply pipe 60 is connected to a gas supply portion 13 disposed inside the outer shell tank 12. The gas supply portion 13 is connected to the lower portion of the gas-liquid generating tank 11 and a gas supplying port 15 is disposed inside the gas-liquid generating tank 11.

The internal space of the gas-liquid generating tank 11 is in communication with the gas supply pipe 60 via a flow passage A1 inside the gas supply portion 13. As a result, gas supplied from the gas supply pipe 60 is supplied to the inside of the gas-liquid generating tank 11. The gas supplying port 15 is disposed on the cylinder axis S, i.e., at the center position of the cylinder.

When the microbubble generating apparatus 1 is placed in water and the electric motor 30 is activated, liquid (e.g., seawater) surrounding the apparatus sucked by the pump 20 is sent from the flow passage W1 of the liquid supplying portion 14 to the flow passage W2 between the outer shell tank 12 and the gas-liquid generating tank 11 and is supplied from the liquid supply ports 17 to the inside of the gas-liquid generating tank 11. Since the supply direction of the liquid from the liquid supply ports 17 is a twisted direction relative to the cylinder axis S of the gas-liquid generating tank 11, a swirling flow C is generated in a constant direction around the axis S in the gas-liquid generating tank 11. A portion of the swirling flow C is discharged from the gas-liquid discharging port 16 into the surrounding liquid. The gas-liquid discharging port 16 is also disposed on the cylinder axis S, i.e., at the center position of the cylinder.

The negative-pressure cavity portion V is generated in the vicinity of the cylinder axis S of the gas-liquid generating tank 11 due to the effect of the swirling flow C. Because of the generation of the negative-pressure cavity portion V, outside gas is taken in via the gas supply portion 13 from the gas supply pipe 60. In the case of a system using a compressor as depicted in FIG. 1, the gas is forcibly supplied from the gas supply pipe 60. Even in the case of a system not using a compressor as depicted in FIG. 3, the gas is naturally supplied from the gas supply pipe 60 due to a negative pressure of the negative-pressure cavity portion V. As described above, in cases such as using this apparatus in liquid with a relatively shallow water depth, gas can be supplied for generating microbubbles even if the forced gas supply is not performed by the compressor. If the compressor is used, more gas can be supplied in addition to the effect of the negative-pressure cavity portion V.

The gas supplied from the gas supply portion 13 via the gas supplying port 15 to the inside of the gas-liquid generating tank 11 is finely divided into microbubbles due to the shearing action of the swirling flow C generated by the liquid squirted into the gas-liquid generating tank 11. The gas-liquid consisting of the liquid with the microbubbles generated is discharged from the gas-liquid discharging port 16 while swirling in the gas-liquid generating tank 11.

As a result, in the embodiment according to the present invention, the gas-liquid with a large amount of microbubbles generated in liquid can efficiently be discharged by the microbubble generator 10 having the double structure made up of the gas-liquid generating tank 11 and the outer shell tank 12.

As described above, in the embodiment according to the preset invention, the double structure is formed by the gas-liquid generating tank 11 and the outer shell tank 12 and liquid is supplied from the outside of the gas-liquid generating tank 11 by using a plurality of the liquid supply ports 17 to the inside of the gas-liquid generating tank 11. No apparatus with such a configuration has hitherto existed and, for example, as compared to a configuration of squirting liquid from the inside of the gas-liquid generating tank 11 toward the inner wall thereof as depicted in FIG. 7, a supply amount of liquid can be increased even by the comparable gas-liquid generating tank 11, thereby generating a strong swirling flow to efficiently generate microbubbles.

Figure 7:
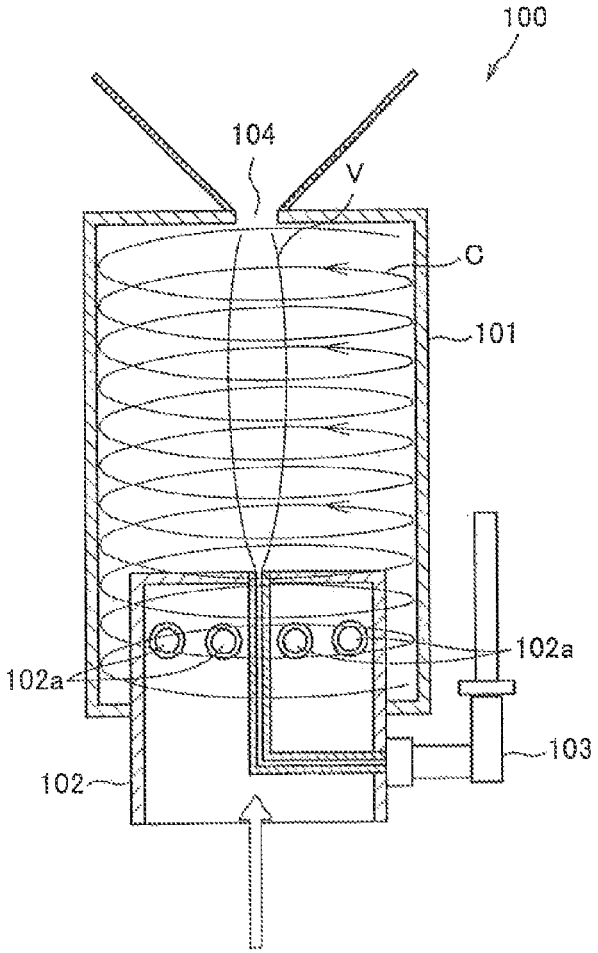
FIG. 7 is a schematic for explaining another example of a conventional microbubble generating apparatus utilizing a swirling flow.

Therefore, since a flow passage is formed around the outer circumference of the gas-liquid generating tank 11 in the configuration according to the present invention, a flow passage cross section can inevitably be made larger and a relatively larger amount of liquid can be pushed out even if pump performance is the same as compared to a configuration of supplying liquid from the inside as depicted in FIG. 7. As a result, because the flow rate is increased when the liquid is supplied from the liquid supply ports 17 to the inside of the gas-liquid generating tank 11, the rotation speed of the swirling flow C can be increased and, therefore, the efficiency of microbubbles generated by dividing gas can be increased.

Although it is basically desirable to steadily generate the negative-pressure cavity portion V along the cylinder axis S of the gas-liquid generating tank 11, the disturbance of the shape thereof, so-called cavity erosion, may occur due to effects of a swirling flow etc. The occurrence of the cavity erosion causes problems of the reduction in generation efficiency of microbubbles as well as the damage or destruction of parts and wall portions inside the gas-liquid generating tank 11 in a short period of time. Particularly when a member making up the gas supplying port 15 is damaged due to the cavity erosion, the steady operation of the apparatus is considerably affected.

In the embodiment of the present invention, out of the circular wall surfaces sealing the both end portions of the cylinder (the bottom surfaces of the cylinder) of the gas-liquid generating tank 11, a circular wall surface 18 on the side including the gas supplying port 15 forms a concave curved shape in the radial direction thereof. This concave shape is a shape having a concave bottom portion on the outer side (lower side in FIG. 4) of the gas-liquid generating tank 11. Therefore, the shape forms a circular groove shape around the gas supplying port 15 in the circular wall surface 18 of the cylinder bottom portion.

As a result, a flow of fluid can be stabilized when the swirling flow C swirling along the inner wall surface of the gas-liquid generating tank 11 rises along the cylinder axis S through the lowest portion of the gas-liquid generating tank 11 (the upper side of the circular wall surface 18) together with gas. Therefore, the position of the negative-pressure cavity portion V generated by the swirling flow C is stabilized without variation and the occurrence of the cavity erosion can be suppressed. Because of the shape of the circular wall surface 18, the apparatus becomes more durable since the inside of the gas-liquid generating tank 11 is hardly damaged or destructed, and the generation efficiency of microbubbles can be stabilized. Particularly, in the configuration with a larger flow rate of liquid supplied from the liquid supply ports 17 causing the strong swirling flow C as in the present invention, the cavitation erosion more easily occurs; however, the formation of the shape of the circular wall surface 18 on the bottom portion enables stable operation.

A top plate 11*a* of the upper portion of the gas-liquid generating tank 11 is detachable from a cylindrical portion 11*b* of the gas-liquid generating tank 11. For example, the top plate 11*a* is configured to be attachable to and detachable from the cylindrical portion 11*b* in a threaded manner. This facilitates cleaning, repair, and maintenance such as component replacement inside the gas-liquid generating tank 11.

With the configuration as described above, since a flow rate of the liquid supplied from the liquid supply ports 17 to the inside of the gas-liquid generating tank 11 is increased by the double-structured microbubble generator 10 supplying the liquid from the flow passage on the outside of the gas-liquid generating tank 11 into the gas-liquid generating tank 11, the microbubble generating apparatus 1 according to the present invention can increase the rotation speed of the swirl flow C and thus can increase the efficiency of microbubble generation. Therefore, the microbubble generating apparatus 1 is simply configured and portable and can generate microbubbles in liquid with high efficiency relative to the scale of the apparatus.

According to the present invention, since the circular wall surface 18 on the cylinder bottom portion of the gas-liquid generating tank 11 is formed into the concave shape, the occurrence of the cavity erosion can be suppressed to stabilize the generation of microbubbles and improve the durability of the apparatus.

EXPLANATIONS OF LETTERS OR NUMERALS

1 . . . microbubble generating apparatus; 10 . . . microbubble generator; 11 . . . gas-liquid generating tank; 11*a* . . . top plate; 11*b* . . . cylindrical portion; 12 . . . outer shell tank; 13 . . . gas supply portion; 14 . . . liquid supplying portion; 15 . . . gas supplying port; 16 . . . gas-liquid discharging port; 17 . . . liquid supply port; 18 . . . circular wall surface; 20 . . . pump; 30 . . . electric motor; 40 . . . flowmeter; 50 . . . check valve; 60 . . . gas supply pipe; 70 . . . power code; 80 . . . operating panel; 81 . . . air filter; 82 . . . air control cock; 83 . . . negative-pressure meter; 101 . . . gas-liquid generating tank; 102 . . . liquid supplying portion; 102*a* . . . nozzle; 103 . . . gas supplying portion; and 104 . . . gas-liquid discharging port.

The invention claimed is:

1. A microbubble generating apparatus having a cylindrical gas-liquid generating tank, a liquid supplying portion for supplying liquid to the gas-liquid generating tank, and a gas supplying portion for supplying gas to the gas-liquid generating tank, generating a swirling flow of the liquid supplied by the liquid supplying portion along an inner surface of a cylinder in the gas-liquid generating tank, producing gas-liquid which is a mixture of the supplied liquid and a gas that is generated by microbubbling the gas supplied from the gas supplying portion by a shearing force of the swirling flow, and discharging the produced gas-liquid, wherein a gas supplying port for supplying the gas to the gas-liquid generating tank by the gas supplying portion is disposed on one of circular wall surfaces sealing both end portions of the cylinder of the gas-liquid generating tank, an outer shell tank at least partially covering the gas-liquid generating tank is included, the outer shell tank forms a gap between a side wall forming a circumferentially curved surface of the cylinder of the gas-liquid generating tank and the outer shell tank as well as a gap between the circular wall surface of the gas-liquid generating tank disposed with the gas supplying port and the outer shell tank to define a space made up of the gaps as a flow passage of the liquid, the liquid is supplied to the flow passage on the outside of the circular wall surface, the supplied liquid flows into the flow passage on the outside of the side wall, the gas-liquid generating tank has liquid supplying ports in communication with the flow passage outside the side wall and the inside of the gas-liquid generating tank to supply the liquid supplied to the flow passage into the inside of the gas-liquid generating tank, a plurality of the liquid supplying ports are disposed at least in a radial direction of the side wall, a liquid supply direction is set such that the liquid swirls in a constant direction around an axis of the gas-liquid generating tank, and the liquid supplying portion supplies the liquid through the flow passage from the liquid supplying ports into the inside of the gas-liquid generating tank to generate the swirl flow.

2. The microbubble generating apparatus as defined in claim 1, wherein the gas supplying port for supplying the gas into the gas-liquid generating tank by the gas supplying portion and a gas-liquid discharging port for discharging the produced gas-liquid from the gas-liquid generating tank are disposed on a cylinder axis of the gas-liquid generating tank, out of the circular wall surfaces sealing the both end portions of the cylinder of the gas-liquid generating tank, the circular wall surface on the side including the gas supplying port forms a concave curved shape in a radial direction on a wall surface between the center and the outer circumference of the circular wall surface, and the concave shape is a shape having a concave bottom portion on the outer side of the gas-liquid generating tank.

3. The microbubble generating apparatus as defined in claim 1, wherein the liquid supply ports are disposed in a plurality of locations for each of a plurality of different positions in the cylinder axis direction of the gas-liquid generating tank.

4. The microbubble generating apparatus as defined in claim 1, wherein a pump making up the liquid supplying portion and an electric motor for driving the pump are integrally configured with the gas-liquid generating tank covered by the outer shell tank.

5. The microbubble generating apparatus as defined in claim 1, wherein a gas supply pipe allowing communication between the inside of the gas-liquid generating tank of the microbubble generating apparatus and outside air is included as the gas supplying portion.

6. The microbubble generating apparatus as defined in claim 5, comprising a compressor connected to an end portion of the gas supply pipe, wherein a gas is delivered into the gas-liquid generating tank by operation of the compressor.

* * * * *